United States Patent [19]

Southard et al.

[11] 4,270,431

[45] Jun. 2, 1981

[54] GLIDE CIRCUIT FOR ELECTRONIC MUSICAL INSTRUMENT

[75] Inventors: James S. Southard, Union, Mich.; Eric R. Bean, South Bend, Ind.

[73] Assignee: Kimball International, Inc., Jasper, Ind.

[21] Appl. No.: 869,321

[22] Filed: Jan. 13, 1978

[51] Int. Cl.[3] ..... G10H 1/02

[52] U.S. Cl. ..... 84/1.24

[58] Field of Search ..... 84/1.24–1.26, 84/DIG. 4, DIG. 8

[56] References Cited

U.S. PATENT DOCUMENTS

| | | | |
|---|---|---|---|
| 3,809,792 | 5/1974 | Deutsch | 84/1.24 |
| 3,854,366 | 12/1974 | Deutsch | 84/1.24 |
| 3,871,262 | 3/1975 | Robinson et al. | 84/1.24 X |
| 3,884,108 | 5/1975 | Deutsch | 84/1.24 |
| 4,073,209 | 2/1978 | Whittington et al. | 84/1.24 |
| 4,080,862 | 3/1978 | Hiyoshi et al. | 84/1.24 |
| 4,083,283 | 4/1978 | Hiyoshi et al. | 84/1.24 |
| 4,083,284 | 4/1978 | Nakada | 84/1.25 |

*Primary Examiner*—Stanley J. Witkowski

*Attorney, Agent, or Firm*—Albert L. Jeffers; John F. Hoffman

[57] ABSTRACT

A circuit for producing a special effect, such as a sliding tone effect or a "Hawaiian Guitar" tonal effect, utilizes a coincidence gating circuit and a bi-stable flip-flop to control a time delay circuit connected to the tone generating circuit of an electronic organ. This circuit responds to the playing of two keys of the keyboard in a rolled chord fashion to cause an automatic detuning of the master oscillator of the tone generating circuit, so that the tones go one semi-tone flat for a short period of time and then glide back into proper tune as controlled by the characteristics of the time delay circuit.

11 Claims, 1 Drawing Figure

GLIDE CIRCUIT FOR ELECTRONIC MUSICAL INSTRUMENT

BACKGROUND OF THE INVENTION

Modern electronic organs are capable of producing a wide variety of tonal effects under the control of different voicing tabs, percussion processing circuitry, automatic rhythm systems and the like. As a consequence, it is possible to produce tonal effects which simulate a wide variety of instruments, including wind instruments, strings, and percussion instruments. In addition, through the use of automatic rhythm sections, unique instrumental effects, such as banjo strumming, trilling and the like can be produced.

A unique tonal effect which has been difficult, if not impossible, to produce on prior art electronic organs is the "glide" or "Hawaiian Guitar" gliding tone effect which is produced by commencing the tone slightly flat (usually a semi-tone flat) and then gliding or sliding into proper tuning for the sustained note in a relatively short, but clearly discernible time interval. On the Hawaiian guitar instrument itself, this is not difficult to achieve manually. In a keyboard instrument, however, because of the inherently different nature of the tone selection and control, this effect is quite difficult to produce. In many electronic organs it is not possible to produce. By providing a detuning access control for the musician, it would be possible to play a note with one hand and to manually detune and bring back into tuning the oscillator used to produce such a tone. To achieve a "Hawaiian Guitar" or glissando effect in this manner is quite cumbersome and severely limits the flexibility available to the musician at such a point in a composition because of the necessity for effecting the sliding control with one hand (or a foot) throughout the time interval of the slide.

As a consequence, it is desirable to provide an automatic control for producing a Hawaiian guitar gliding sound, delayed vibrato, or glissando with a minimum of effort on the part of the musician and in a manner which can be effected by even a musician of moderate skill.

SUMMARY OF THE INVENTION

It is an object of this invention to provide an improved electronic musical instrument.

It is an additional object of this invention to provide an improved tonal control circuit for an electronic musical instrument.

It is another object of this invention to provide an improved tonal control circuit for an electronic musical instrument which operates to effect gliding tonal changes.

It is a further object of this invention to provide a circuit for an electronic musical instrument for automatically producing a Hawaiian guitar tonal effect.

In accordance with a preferred embodiment of this invention, an electronic musical instrument, such as an electronic organ, having at least one keyboard with different keys representative of different musical notes and having at least one tone generating circuit connected to the keys for producing tones corresponding to the musical notes selected by the playing of the keys, includes a circuit for producing a gliding tone effect which is coupled to the tone generating circuit and is responsive to the sequential closure of first and second keys of the keyboard in a first time interval for detuning the tone generator circuit in a pre-established manner over a fixed time period.

DETAILED DESCRIPTION OF THE PREFERRED EMBODIMENT

Figure 1:
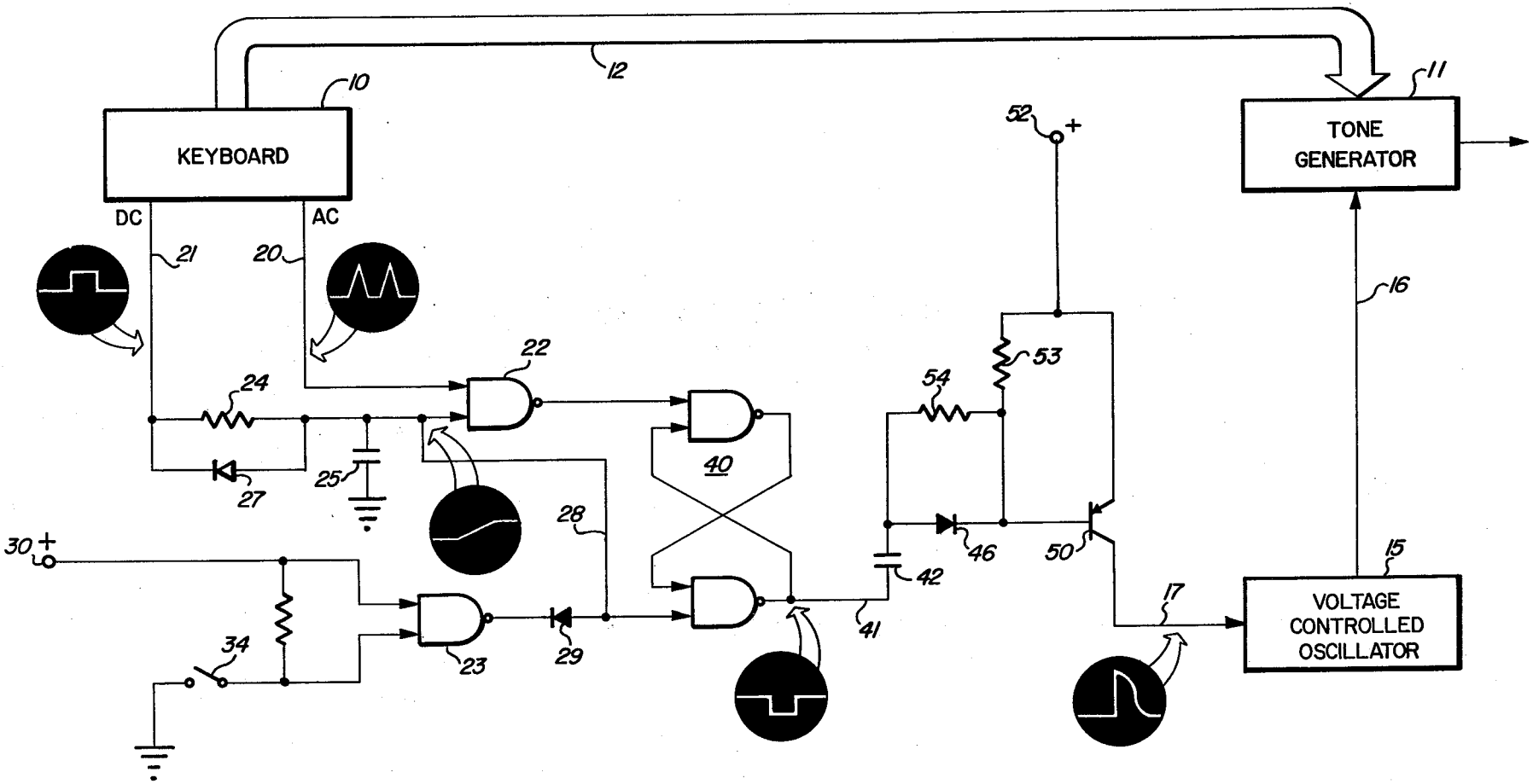
FIG. 1 is a schematic diagram of a preferred embodiment of the invention.

Referring now to FIG. 1, there is shown, in block diagram form, a keyboard 10 and a tone generator 11 of the type which are commonly employed in electronic organs and other keyboard electronic musical instruments, which are to be considered covered by the term "organ" as used in the following description. The particular circuit configuration of the organ is not important, and a number of different circuit implementations can be employed. One type of organ with which the system is particularly well suited, is a digital time-division multiplex organ system such as disclosed in U.S. Pat. No. 3,955,460, issued May 11, 1976, to James S. Southard and assigned to the same assignee as the present invention. The details of the particular organ system which is used are not important.

Playing or operation of keys in the keyboard 10 (which may include one or several manuals and pedalboards) controls by way of circuitry (not shown) represented by the plural interconnecting leads 12 to control the tones generated by the tone generator circuit 11. Preferably the tone generator circuit 11 is of a type known as a top octave synthesizer (TOS) tone generator circuit, which utilizes a single stable reference oscillator to supply high frequency signals to the TOS circuit where these signals are divided down into the tone frequencies for the respective octaves and notes to be produced by the organ. As illustrated in the drawing, this oscillator is shown as a voltage controlled oscillator 15 which normally provides a stable high frequency output signal on a lead 16 to the tone generator 11. The frequency of this signal is determined by the internal parameters of the oscillator 15, but in addition this signal can be varied by the voltage appearing on a lead 17 to cause the output frequency of the oscillator 15 to vary from its normal stable frequency.

When a key of the keyboard 10 is played or depressed, this playing ordinarily is sensed by the closure of an electric or electronic switch to produce a signal representative of the key closure. Two signals are actually produced, an AC or short duration pulse representative of the key closure and a DC signal which is present so long as the key is held down in its playing position. In the circuit shown in the drawing all of the AC pulses are gated together over a common lead 20 to one of two inputs of a NAND gate 22. Similarly, all of the DC signals are gated together in the keyboard 10 and applied over a common lead 21 to the other input of the NAND gate 22.

The pulses applied over the lead 21, however, are not connected directly to the second input of the NAND gate 22, but instead are applied through an RC time delay network comprising a resistor 24 and a capacitor 25 so that the arrival of the initial signal on the lead 21, representative of the first key closure, to the second input of the NAND gate 22 is delayed from the arrival of the AC pulse representative of that same key closure. The resistor 24 is shunted by a diode 27 so that whenever the DC pulse or signal ceases to appear on the lead 21, the timing capacitor 25 rapidly discharges through the diode 27 to reset the circuit to its initial operating condition.

The NAND gate 22, in conjunction with the RC time delay circuit 24, 25, is used to produce an output pulse in response to the sequential playing of two or more notes in a rolled chord or legatto fashion (playing of one note and holding it while playing the second note). When the first key is depressed, both an AC trigger pulse and a DC pulse or DC level are produced simultaneously on the leads 20 and 21. These pulses, however, do not arrive simultaneously at the two inputs of the NAND gate 22 since the RC circuit 24, 25 acts as a time delay circuit for the change in DC signal level illustrated on the lead 21. As a consequence, the AC trigger pulse appearing on the lead 20 for this first key arrives at the upper input of the NAND gate 22 and is gone prior to the time that the DC level at the lower input of the NAND gate 22 rises high enough to operate as a logic binary "1" to enable the NAND gate 22. As a consequence, no input pulse is obtained from the output of the NAND gate 22 for the playing of this first note.

The operation of the NAND gate 22 also is controlled by a signal on a control lead 28 connected to the anode of a diode 29, which in turn has its cathode connected to the output of a second NAND gate 23. Normally, both inputs of the NAND gate 23 are enabled from a source of positive DC potential applied to a terminal 30 to cause the output of the NAND gate 23 to remain low. This low potential is coupled by the diode 29 to the lower input of the NAND gate 22, disabling this NAND gate under most conditions of operation of the organ.

When the organ is to be played in its "Hawaiian Guitar" or automatic glide mode, however, a switch 34, connected to ground is closed to cause a low or binary "0" potential to be applied to the lower input of the NAND gate 23. Thus, whenever the switch 34 is closed, the output of the NAND gate 23 rises to a positive potential. This back-biases the diode 29 and removes the disabling signal from the lead 28. In this mode of operation, the NAND gate 22 then is responsive to the delayed signal level appearing on the lead 21.

If the circuit is in its "Hawaiian Guitar" mode with the switch 34 closed, and the first key played in the keyboard 10 continues to be held down at the time a second key is played (rolled chord playing), another AC trigger pulse is applied over the lead 20 to the upper input of the NAND gate 22. The lower input of the NAND gate 22 now is enabled or at a logical "1" where it remains so long as one or more keys continuously are played without interruption in the keyboard 10. As a result, playing the second key produces a negative-going trigger pulse on the output of the NAND gate 22. This pulse is applied to a trigger input of a cross-coupled NAND gate bi-stable multivibrator or flip-flop 40 to trigger the multivibrator 40 from a first stable state to a second stable state, producing a negative or "low" output signal on its output lead 41. The multivibrator 40 normally is in its first stable state producing a steady high or positive output on the lead 41.

So long as the output of the multivibrator 40 is high, the base of a PNP transistor 50 is biased off. As shown in the drawing, the collector of the transistor 50 is connected to the lead 17. In this state of operation, the frequency of the voltage controlled oscillator 15 is determined solely by its internal adjustments and no control signals are applied to it over the lead 17.

As soon as the output on the bi-stable multivibrator 40, however, drops to its low or negative state, the capacitor 42 commences charging from a source of positive potential applied to a terminal 52 at a rate determined by a pair of voltage divider resistors 53 and 54. The junction of the resistors 53 and 54 is connected to the base of the transistor 50, which immediately is rendered heavily conductive coincident with the negative-going pulse transistion on the output lead 41. As the charge on the capacitor 42 builds up, the current applied to the base of the transistor 50 continues to decrease. As a consequence, the conductivity of the transistor 50 also diminishes, producing the waveform shown on the lead 17. After a period of time determined by the parameters of the capacitor 42 and the resistors 53 and 54, the charge on the capacitor 42 reaches a level which once again biases off the transistor 50.

The musical effect of the operation of the circuit which has been just described is that the signal applied over the lead 17 to the voltage controlled oscillator 15 initially causes an automatic detuning of the voltage controlled master oscillator 15 to produce notes in the tone generator 11 which go one semi-tone flat at the inception of the signal on the lead 17. The tones then slide or "glide" back into tune in accordance with the decay waveform shown in the lead 17 and the total time for this to occur is determined by the RC circuit comprising the capacitor 42 and resistors 53 and 54.

If all of the keys in the keyboard 10 are released before the time constant of the capacitors 42 and resistor 53, 54 has caused the transistor 50 to turn off, the flip-flop 40 is reset and forces the tuning immediately to turn to normal by discharging the capacitor 42 which in turn immediately reverse-biases the transistor 50 to its off condition. To insure that this occurs, the diode 27 shunted across the resistor 24 immediately discharges the capacitor 25 when all of the keys of the keyboard 10 are released (returning the DC level back to binary "0"). As stated above, this disables the NAND gate 22. In addition, the negative pulse transistion which occurs also is applied over the lead 28 to the lower trigger input of the flip-flop 40 to reset it to its first stable state, causing the output of the flip-flop on the lead 41 to go high.

It also should be noted that it is necessary to release all of the keys in the keyboard 10 prior to initiating another "glide" sequence, since the flip-flop 40 must be reset in order to discharge the capacitor 42 through the diode 46 to ready the time delay circuit for a new timing cycle, whereupon the sequence of operation described above is repeated.

The amount of time required between the playing of the first and second notes for the circuit to respond depends on the RC time delay provided by the resistor 24 and capacitor 25. If this time constant is too short, the circuit may respond when the player does not want it to. For example, when rapid legatto keyboard playing of a sequence of notes is desired, the Hawaiian guitar or "glide" effect usually is not desired. The circuit should be nonresponsive to this type of playing. On the other hand, if the time constant provided by the resistor 24 and capacitor 25 is too long, the musician will have to exaggerate the "roll" from the first to the second note in order to get the circuit to respond when the Hawaiian guitar "glide" effect is desired. It is apparent then, that a trade-off between these two extremes is necessary and the time constant of the circuit 24, 25 must be adjusted in accordance with the desires of the musician.

Similarly, the length of the glide is determined by the RC delay network consisting of the capacitor 42 and resistors 53 and 54. If the capacitor 42 is permitted to charge rapidly, a very rapid glide from the inception of the "Hawaiian Guitar" effect to a return to normal tuning of the tone generator circuit 11 through the oscillator 15 is achieved. If a relatively long time constant is provided by this circuit, a very slow return to normal tuning is the result. Once again, the particular musical effect desired must be considered. It is preferable to permit some external control of the length of the "glide" effect and this can be accomplished by making one or both of the resistors 53 and 54 variable potentiometers with an external access for the musician.

As recognized by those skilled in the art the circuit may be used to activate other special effects other than the glide effect. Such special effects include vibrato, delayed vibrato, razz, various rhythm and percussion effects, voicing and control registration changes to name but a few. All effects would be activated by the same keyboard playing technique. For some effects a steady on condition would be desired rather than one that turns off after a predetermined time. This would be possible by using the output 41 of multivibrator 40 instead of the transistor 50 output 17.

It is also possible to use an output of multivibrator 40 as a delayed DC input to a second circuit similar to FIG. 1. If a first key or group of keys were played, then a second key or group of keys played and finally a third key or group of keys were played while at least one key remains activated all during the sequence, then the effect would only occur at the activation of the third key or group of keys. The circuit could be cascaded many more times creating an even greater activation sequence necessary to trigger a special effect but we soon run out of fingers to actuate keys for triggering such effects.

Although the invention has been described above in conjunction with the preferred embodiment shown in the drawing, variations utilizing the same inventive concepts will occur to those skilled in this art without departing from the true scope of the invention as defined by the following claims.

We claim:

1. In a keyboard musical instrument including a keyboard, a tone generator and a controlled reference oscillator for supplying a reference frequency signal to the tone generator, means for determining when a second key has been activated subsequent to the activation of a first key of the keyboard and during the time that the first key remains activated, means connected to the determining means and to the controlled oscillator for detuning the tone generator, said detuning means producing a transient control signal in response to the determination of the determining means of the activation of a second key subsequent to the activation of a first key and during the time that the first key remains activated, the determining means being connected between the keyboard and the detuning means, the transient control signal automatically returning to its initial state within a predetermined time interval, the control signal when applied to the controlled oscillator detuning the tone generator and causing the tone generator automatically to glide back into tune as the control signal returns to its initial state.

2. Keyboard musical instrument according to claim 1, wherein the determining means includes a time delay circuit, a coincidence gate, first means connected to the coincidence gate through the time delay circuit supplying a signal of a duration corresponding to the length of time a first key is activated, and a second means connected to the coincidence gate, supplying a signal indicating that a second key has been activated.

3. A keyboard musical instrument according to claim 2, wherein the detuning means includes a capacitor and wherein the determining means includes means connected between the coincidence gate and the capacitor for altering the electrical state of the capacitor and means connected to the capacitor for automatically returning the capacitor to its initial unaltered electrical state.

4. The keyboard instrument according to claim 3, wherein the detuning means includes a switch circuit connected between the capacitor and the controlled oscillator, the state of the switch circuit being responsive to the electrical state of the capacitor.

5. In a keyboard musical instrument including a keyboard, and a tone generator responsive to the keyboard, a circuit for producing a sliding tone effect including:

first means for supplying a first pulse in response to the activation of a first key, the duration of the first pulse corresponding to the length of time the first key is activated;

second means for supplying a second pulse of relatively short duration in response to the activation of a second key, the second pulse duration being independent of the length of time the second key remains activated;

means for determining that a second key has been activated subsequent to a first key and during the time period when the first key remains activated, the determining means including a coincidence gate responsive to the first and the second supplying means; and means responsive to the determining means for detuning the tone generator and subsequently and automatically retuning the tone generator, the detuning means including a controlled reference oscillator for supplying reference frequency signals to the tone generator and means for supplying a control signal to the oscillator causing the signals supplied by the oscillator to change in frequency, the control signal automatically returning to its initial state causing the signals supplied by the oscillator to return ot its reference frequency.

6. The musical instrument in accordance with claim 5 wherein the first supply means includes a time delay circuit connected between the keyboard and the coincidence gate.

7. The circuit in accordance with claim 5 wherein the detuning means includes a resistor-capacitor (RC) circuit means for producing the control signal applied to the oscillator.

8. In an electronic musical instrument having at least one keyboard, with a plurality of keys representative of different musical notes, and a tone generating circuit coupled with such keys for producing tones corresponding to the musical notes selected by the playing of the keys, a means for producing a special tone effect including a detuning of the tone generating circuit, said means for producing being coupled with the tone generating circuit and said keyboard and being responsive to the sequential playing of first and second keys of the keyboard in a predetermined manner in a predetermined time interval for producing said special tone effect for a predetermined period, said means for producing including:

a bi-stable circuit means having a trigger input and normally reset to a first stable state and triggered to a second stable state by signals applied to the trigger input in response to the sequential closure of the first and second keys in said predetermined time interval;

and a timing control circuit coupled to the output of said bi-stable circuit and to said tone generating circuit for producing a control signal varying in said predetermined manner for effecting said detuning of said tone generating circuit, said timing control circuit including a normally nonconductive transistor switch means and time delay circuit means with said time delay circuit means being connected to the control electrode of said transistor switch means and the output of said bi-stable circuit means and rendered effective to bias said transistor switch means into a first state of conduction in response to the second stable state of said bi-stable circuit means, and further causing the conductivity of said transistor switch means to change from such first state of conduction to a second state of conduction in said predetermined time period.

9. The combination according to claim 8 wherein the first state of conduction of said transistor switch means is its conductive state and the second state is its nonconductive state.

10. The combination according to claim 8 further including coincidence gate circuit means, having an output coupled with the input of said bi-stable circuit means and having first and second inputs connected to first and second outputs of the keyboard, with signals on the first input to said coincidence gate means comprising a pulse of short duration which occurs upon the closure of any key in the keyboard, and the second input to said coincidence gate means comprising a disabling signal level when no key in the keyboard is played and changing to an enabling signal so long as any key in the keyboard is played; and a time delay circuit connected between the second output of the keyboard and the second input of said coincidence gate means to delay the application of said enabling signal to said coincidence gate means for said predetermined time interval, the output of said coincidence gate means connected to the trigger input of said bi-stable circuit means.

11. The combination according to claim 10 further including means coupled with said coincidence gate means and said bi-stable circuit means for selectively disabling the operation of said coincidence gate means and resetting said bi-stable circuit means to its first stable state.

* * * * *